US005758374A

United States Patent [19]

Ronci

[11] Patent Number: 5,758,374

[45] Date of Patent: Jun. 2, 1998

[54] PORTABLE TABLE ASSEMBLY

[76] Inventor: Samuel Ronci, 416 Mittersill Rd., Franconia, N.H. 03580

[21] Appl. No.: 650,236

[22] Filed: May 20, 1996

[51] Int. Cl.[6] ..... A61G 13/00; A61G 7/075

[52] U.S. Cl. ..... 5/507.1; 5/621; 5/623; 108/65; 108/152

[58] Field of Search ..... 5/621, 622, 623, 5/624, 507.1, 181, 185, 310, 312; 108/65, 69, 44, 152

[56] References Cited

U.S. PATENT DOCUMENTS

| | | | |
|---|---|---|---|
| 2,872,259 | 3/1959 | Thorpe | 5/621 X |
| 2,945,731 | 7/1960 | Tutrone | 5/621 X |
| 3,046,072 | 7/1962 | Douglass, Jr. et al. | 5/623 X |
| 3,327,328 | 6/1967 | Slivoski | 5/181 |
| 3,554,139 | 1/1971 | Rosner | 108/44 |
| 4,054,282 | 10/1977 | Hamer | 5/623 X |
| 5,135,210 | 8/1992 | Michelson | 5/623 X |
| 5,152,486 | 10/1992 | Kabanek et al. | 5/507.1 X |
| 5,287,575 | 2/1994 | Allen et al. | 5/623 |

*Primary Examiner*—Michael F. Trettel
*Attorney, Agent, or Firm*—Donald J. Perreault

[57] ABSTRACT

A portable table assembly including a table and a clamp. Plugs extend from a surface of the table and matingly engage and lock within corresponding receptacles in the clamp to secure the table to the clamp. The clamp is secured to a fixed position, and has a adjustable leg which extends slightly forward of the clamp to prevent downward rotation of the clamp caused by loads on the table. An optional adjustable outboard leg may be fixed to the distal end of the table, and may be folded under the table when not in use. In another embodiment, a table is provided with mounting brackets fixed to its end. Rail brackets are mounted to a surgical table rail, and the mounting brackets fit within a slot in the rail brackets. The table is secured to the rail brackets by inserting a handled pin into the rail bracket through a slot in the mounting bracket. The distal end of the table is supported by an outboard leg assembly.

40 Claims, 14 Drawing Sheets

PORTABLE TABLE ASSEMBLY

FIELD OF THE INVENTION

This invention relates to a portable table assembly, and especially to a portable table assembly which is particularly useful in connection with surgical and tractioning procedures.

BACKGROUND OF THE INVENTION

Conventional portable table designs take a variety of forms, and are used in a variety of applications. The common purpose for the design, however, is to provide a temporary elevated space for supporting objects. When the table is no longer needed, it is merely removed from its temporary location, and stored in a convenient, inconspicuous location.

In medical and surgical environments, e.g. an operating room or doctors office, portable table systems are particularly useful due to the necessary flexibility of use required for the space. For example, in an operating room various surgical procedures require dedicated monitoring equipment, surgical devices, traction assemblies, etc. All of these devices are typically constructed to be portable by providing a wheeled chassis, or by providing a design which can be removed and stored in a facile and efficient manner.

In the case of surgical table assemblies, portability is but one many necessary qualities. It is perhaps more important in surgical applications that a portable table be connected to an operating room table in a reliable, strong, and stable fashion.

For example, in intricate microsurgery applications, such as hand surgery, excessive flexing or rocking of the table surface is entirely unacceptable. Also, the table must be capable of supporting surgical equipment, a patient's weight, and the force applied by at least one physician as the surgery is performed. In cases where traction is applied to a patient's limb for surgery, the table must also withstand the significant force and weight applied by the tractioning equipment.

In addition, various surgical procedures require dedicated table shapes and sizes. In adult surgical applications, for example, a long rectangular table attached temporarily to the operating room table may be appropriate. However, the adult table may be too long for pediatric use where a shorter table would be more appropriate. Also, rectangular tables with concave sides are typically required for hand surgery, whereas tables with "cut-outs" may be necessary for surgery involving tractioning systems.

In surgical applications, another desirable quality is permeability with respect to x-rays so that the table is "invisible" to x-ray and c-arm imaging. With this feature, an x-ray image can be obtained of a patient's appendage from above and/or beneath the table with the appendage fixed in an appropriate position on the table. In delicate surgeries and where tractioning is used, the x-ray image can, therefore, be taken without significantly disturbing the appendage. Also, when the table is "invisible" to x-rays, the x-ray image is improved and lower x-ray doses are necessary as compared to conventional table systems.

To date, prior art portable tables have failed achieve the above desirable qualities. Accordingly, there is a long felt need in the art for a portable table assembly which is stable, strong, and easily removed and installed. In addition, there is a need in the art in connection with surgical applications for a portable table assembly which facilitates the connection of various sized and shaped tables to an operating room table. There is a further need in the art for a table for use in surgical applications with the above features which is also invisible to x-ray and c-arm imaging.

OBJECTS OF THE PRESENT INVENTION

Accordingly, it is an object of the present invention to provide a novel portable table assembly which may be temporarily placed in a fixed position in a stable, strong, and reliable fashion.

It is an another object of the present invention to provide a novel portable table assembly which includes a table portion and a clamp portion which matingly engage each other through a cooperating plug/receptacle connection to removably fix the table portion to the clamp portion.

Another object of the present invention to provide a novel portable table assembly which includes a table portion which is essentially invisible to x-ray and c-arm imaging.

A further object of the present invention is to provide a novel portable table assembly which includes a table portion fixed to a clamp portion and a removable extension leg for supporting a distal end of the table.

Still another object of the present invention to provide a novel clamp portion for a portable table assembly which may be fixed in position, e.g. to an operating room table, to receive various sized and shaped table portions.

Still another object of the present invention to provide a novel clamp portion for a portable table assembly which includes at least one plug or receptacle which matingly connects to a table portion to fix the table portion to said clamp portion.

Still another object of the present invention to provide a novel clamp portion for a portable table assembly which a supporting leg extending therefrom at an angle toward a table portion, to thereby prevent downward rotation of the clamp portion.

Yet another object of the present invention to provide a novel table portion for a portable table assembly for use in surgical applications which includes at least one plug or receptacle which matingly connects to a clamp portion to fix the table portion to the clamp portion.

Yet another object of the present invention is to provide a novel table portion for a portable table assembly which is essentially invisible to x-ray and c-arm imaging.

Yet another object of the present invention is to provide a novel table portion which has a generally rectangular cross section wherein a base of the rectangular cross section contacts a front surface of a clamp portion to thereby provide a support surface between the table and clamp portions.

Yet another object of the present invention is to provide a novel outboard leg for a portable table assembly which is removably attachable to the assembly for supporting an end of a table portion which is distal from its connection to a clamp portion.

Yet another object of the present invention is to provide a novel portable extension table assembly which is removably attachable to a surgical table to extend the surface of the surgical table.

These and other objects of the present invention will become apparent from a review of the following detailed description of the invention, taken together with the drawing, in which like reference numbers refer to like members throughout the different views.

SUMMARY OF THE INVENTION

Figure 1:
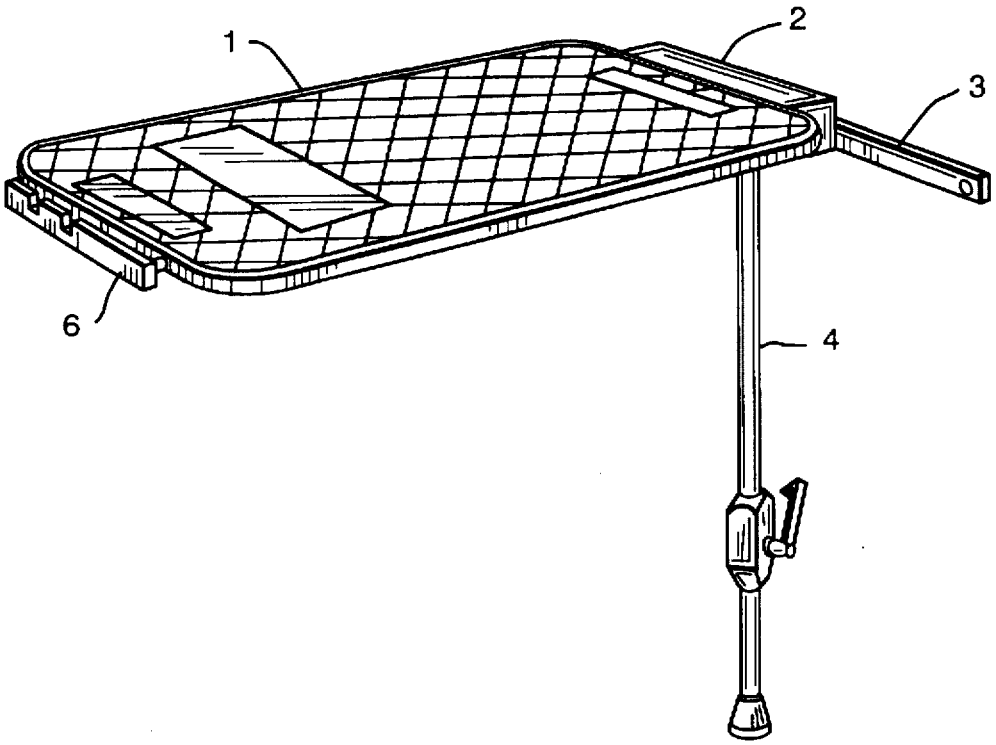
FIG. 1: is perspective view of one embodiment of a portable table assembly according to the invention.
Figure 2:
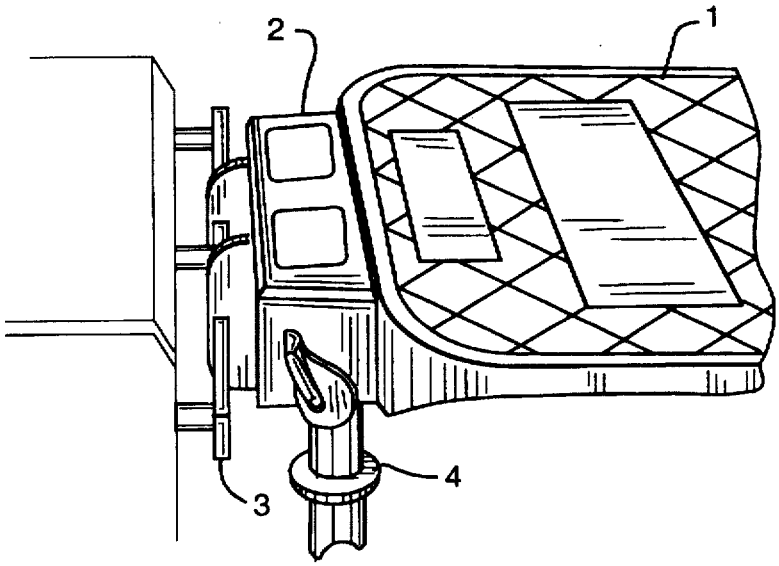
FIG. 2: is a side view of a table and clamp connection according to the present invention.

According to the present invention, there is provided a portable table assembly which may be efficiently installed and removed, and which is capable of reliably supporting significant loads. In one embodiment, the table assembly includes a table having at least one plug extending from a surface thereof and a clamp for securing the table to a fixed position, e.g. a stationary surgical rail. The table preferably includes a non-compressible foam core with a carbon outer shell, and is triangular in cross section. The base of the triangular cross section is a bearing surface end of the table in contact with a front of the clamp.

The clamp has at least one receptacle formed therein, and the plug is dimensioned to matingly engage the receptacle thereby securing the table to the clamp. Preferably, the plug has a notch formed therein and the receptacle includes a receptacle bore formed in a housing of the clamp. The clamp includes a piston bore which perpendicularly intersects the receptacle bore, and a piston is fixed in the piston bore. The piston is axially movable in the piston bore to intersect the notch thereby releasably locking the plug within the receptacle bore. Preferably, the piston is positioned against an ellipsoidal cam in the piston bore, and is axially movable upon rotation of the cam. In addition, the clamp preferably includes a pair of jaws formed on a back surface thereof, and the jaws are dimensioned to receive the stationary rail therebetween.

In the preferred embodiment, the assembly further includes a leg fixed to a bottom of the clamp which extends angularly from the clamp in the direction of the table. This structure tends to prevent downward rotation of the clamp about the stationary rail. The leg is connected to the bottom of the clamp through a leg bracket and a leg pin with the leg being connected to the leg pin. The leg is adjustable in height and includes: a connector portion having a central bore therethrough; an upper leg portion fixed within the central bore and extending from a top of the connector portion; and a lower leg portion within the central bore and extending from a bottom of the connector portion. The lower leg portion is slidable within the central bore and the upper leg portion to adjust the length of the leg. The connector portion preferably includes a stop pin bore formed perpendicularly to the central bore. The stop pin is fixed within the stop pin bore, and is axially movable in the stop pin bore to engage the lower leg portion to thereby fix the lower leg portion within the central bore.

Optionally, the assembly may include a leg, preferably an adjustable outboard leg assembly, fixed to an end rail of the table. The outboard leg assembly includes a pair of rail brackets adapted to engage the end rail to secure the assembly to the end rail. A pivot bar is fixed between the rail brackets adjacent the ends thereof, and a pivot is rotatingly connected to the pivot bar. An adjustable leg, as described above, is connected to the pivot bar to provide height adjustment capability.

In another embodiment, the portable table assembly includes a table with a mounting bracket secured to an end thereof. Rail brackets are fixed to the stationary surgical rail, and have slots formed therein for removably receiving the mounting bracket to thereby secure the table to the rail bracket. Preferably, the end of the table includes an adjustable leg, as described above, fixed thereto.

DETAILED DESCRIPTION OF THE INVENTION

The present invention will be described herein in connection with its use for surgical applications. It is to be understood, however, that the invention may be used in a wide variety of non-surgical applications. For example, the table assembly described herein can be fixed on or within an automobile, on a workbench, on in a variety of other fixed locations. In fact, the versatility of the present invention is unlimited due to the portability of its constituent parts.

Turning now to FIG. 1, the invention will be described broadly, with a more detailed description following. A portable table assembly according to the present invention generally comprises a table 1 which is removably connectable to a clamp 2. The clamp 2 is secured to a fixed object, e.g. to the rail 3 of an operating room table, and has an adjustable leg assembly 4 which tends to prevent downward rotation of the clamp on the rail. An optional outboard leg assembly 5, shown more particularly in FIG. 27 may be attached to a end rail 6 of the table 1 for providing added stability for intricate procedures such as microsurgery and the like. The outboard leg assembly 5 is adjustable in height, and can fold underneath the table when not in use.

Figure 3:
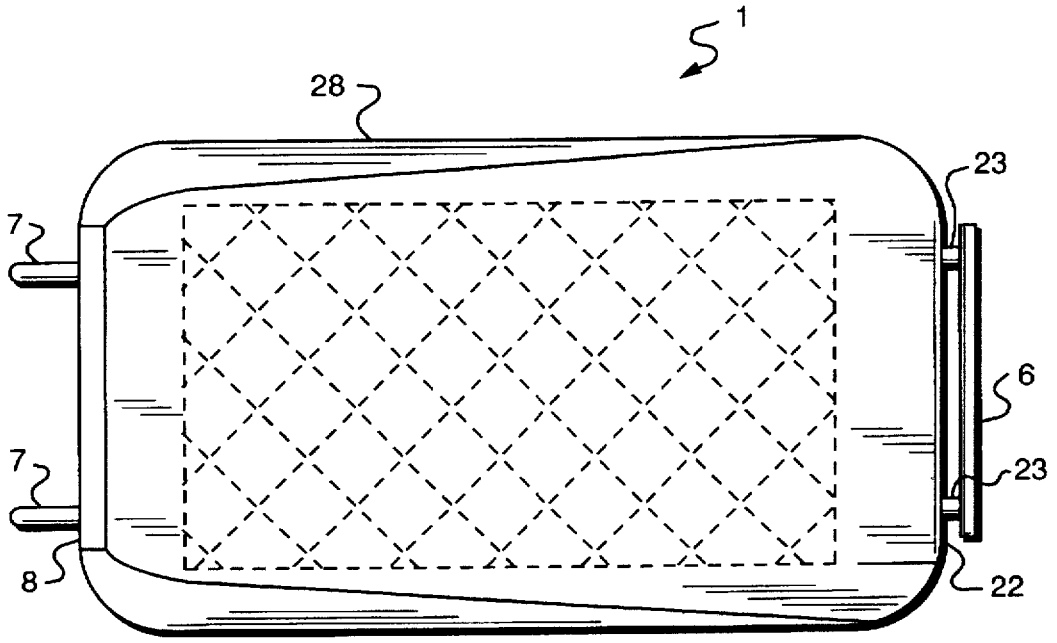
FIG. 3: is a top view of one embodiment of a table according to the invention.
Figure 20:
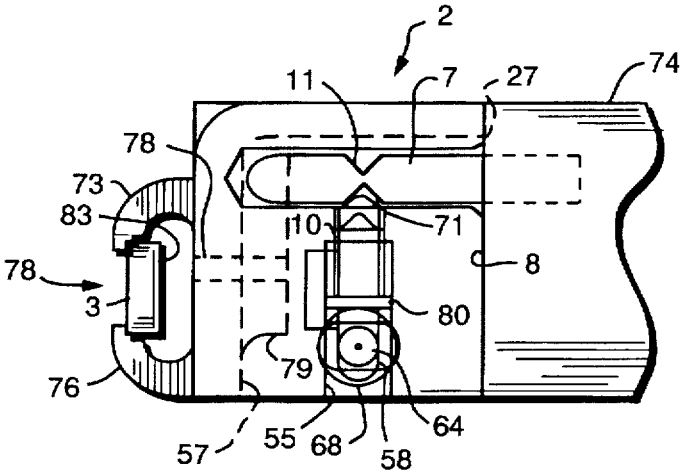
FIG. 20: is a side view of the clamp of FIG. 15 as connected to a table and surgical rail according to the invention.

According to the invention, the connection between the table 1 and the clamp 2 is made through a mating plug/receptacle connection. As shown in FIGS. 3 and 20, for example, male plugs 7 extend from an edge 8 of the table and matingly engage corresponding receptacles 9 within the clamp. The plugs 7 may be locked within the receptacles 9 by a moving a locking piston 10 within the clamp into engagement with a recess or notch 11 in the plugs. With this arrangement, a variety of table sizes and shapes can be used with the same clamp according to intended use. In addition, the table and clamp can be separately stored in a convenient location and installed in a rapid and facile manner.

Advantageously, the table 1 is formed from known carbon fiber and foam materials which are "invisible" to x-ray and c-arm imaging. Thus, x-rays of a limb or appendage may be taken with the limb positioned directly on the table. In addition, tractioning equipment may be utilized to position relevant portions of the limb on the table for x-ray or c-arm imaging.

Figure 4:
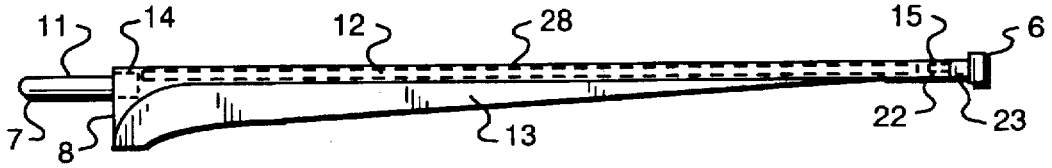
FIG. 4: is a side sectional view the table shown in FIG. 3.
Figure 5:
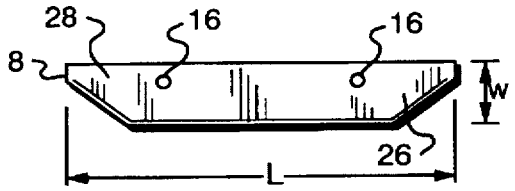
FIG. 5: is an end view of the table of FIG. 3.
Figure 6:
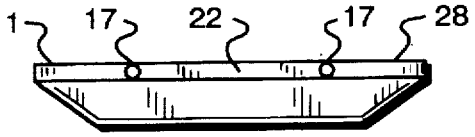
FIG. 6: is an end view of the table of FIG. 3 taken from the opposite end from that shown in FIG. 4.

Referring to FIG. 4, the table is preferably made by first machining a light-weight, non-compressible closed-cell foam core 12 to the basic shape of the table. A carbon fiber material forms the outer shell 13 of the table. An initial layer carbon fiber impregnated with a known adhesive is filled to a specified level within a mold (not shown). Appropriately sized phenolic blocks 14, 15, having bores therein are placed within the mold to provide receptacles 16, 17 in the table for the plugs, and the end rail 6, as shown in FIGS. 5 and 6 respectively. The foam core 12 is then placed into position on top of the initial layer, and a second layer of the carbon fiber/adhesive material is placed over the core to fill the mold. The table 1 is then cured within a conventional curing oven until the outer shell 13 appropriately hardens. The table is sanded to remove rough edges and finished. In the embodiment of FIG. 3, the finished table is about 32" long and 18" wide.

Preferably, as shown in FIG. 4, the table 1 is formed with a generally triangular side-view cross-section, with the end 8 from which the plugs 7 extend being the base of the triangular shape. With reference also to FIG. 5, the width w of the end 8 is preferably about 3", and the length l is about 18". With this construction, the end 8 provides a long and wide bearing surface 26 against the front 27 (FIG. 20) of the clamp 2 for supporting loads on the table. At the same time, the table tapers toward the end 22 to about 0.75" to maintain an overall light weight, i.e. about 8 lbs.

Figure 8:
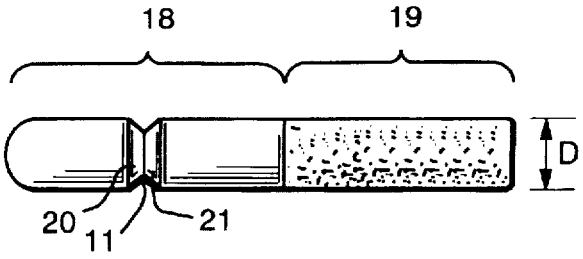
FIG. 8: is a side view of a table plug according to the present invention.

The plugs 7 are fixed in the bores 16 which are positioned about 0.75" from the top surface 28 of the table, and 9" apart centrally in end 8. Importantly, by maintaining uniform spacing between the plugs for various table designs, each design may be used with the same clamp 2. As shown particularly in FIG. 8, the plugs 7 are formed of steel with the portion 18, which is to extend from the table 1, finished smooth. The remainder 19 of the plug is sandblasted to provide a rough surface for securing the plug within the bores 16 with an adhesive. In the preferred embodiment, the diameter D of the plug 7 is about 0.625 inches. The sandblasted area 19 of the plug extends about two inches from the end, while the portion of the plug which extends from the table 18 is 2.5" in length. The locking notch 11 is formed in the plug preferably by machining two 45 degree bevels 20,21 to meet at a diameter of about 0.375", approximately 1.25 inches from the end the plug. The beveled edges 20, 21 of the notch 11 provide smooth surfaces for contacting the locking piston 10 in the clamp 2, as shown in FIG. 20, and aligning the locking piston centrally within the notch 11.

Figure 7:
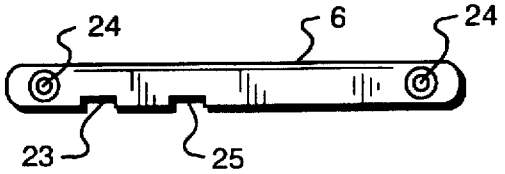
FIG. 7: is a front view of an end rail for a table according to the present invention.
Figure 27:
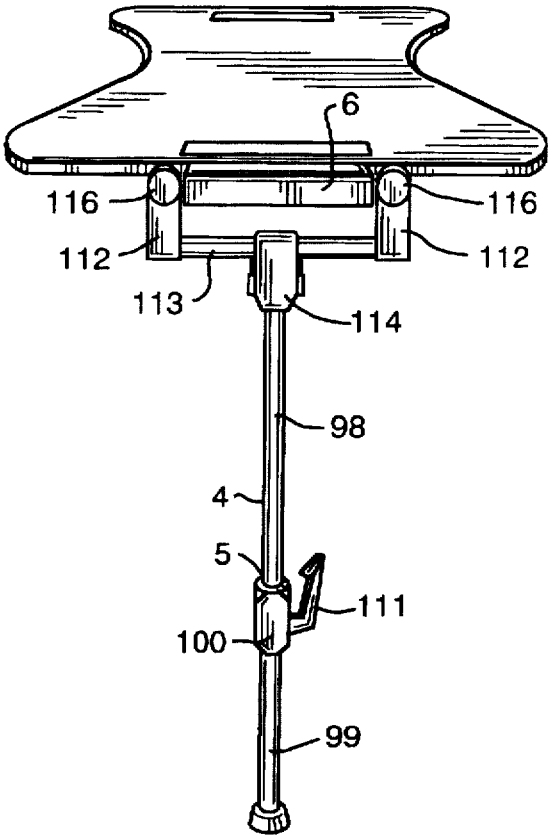
FIG. 27: is a front view of an outboard leg assembly as attached to a table assembly according to the invention.
Figure 28:
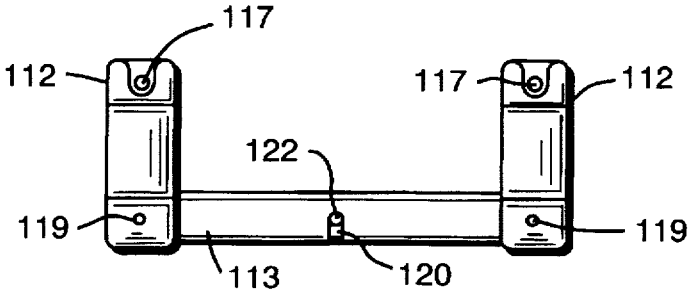
FIG. 28: is a back view of the rail bracket and pivot bar assembly of the outboard leg assembly of FIG. 26.

Referring to FIGS. 3 and 7, the end rail 6 is machined from aluminum, and is fixed to the end 22 of the table to provide a location for optionally securing an outboard leg assembly as shown in FIG. 27 and/or tractioning equipment. In the preferred embodiment, brass inserts (not shown) are tapped and press fit into the bores 17 (FIG. 6). Spacers 23 are positioned between the rail 6 and the end 22 of the table, and the rail is screwed to the table through the openings 24 and the spacers 23 into the brass inserts. Advantageously, the rail 6 is formed with key ways 25 for securing known tractioning equipment thereto. Preferably, the key ways are 0.87" in width and 0.31" in depth. The rail is preferably about 12" in length, 1.125" in width, and 0.375" thick.

Figure 9:
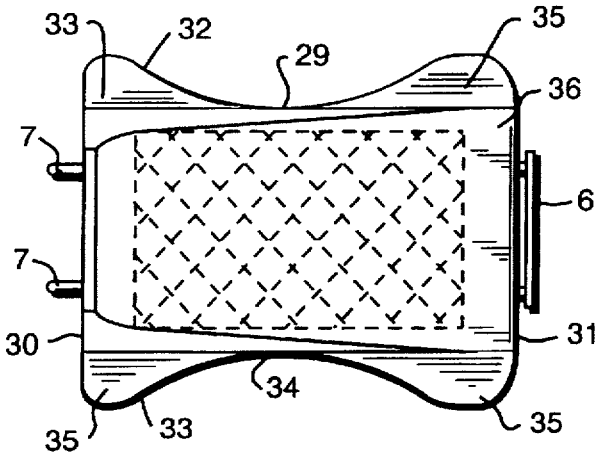
FIG. 9: is a top view of an alternative embodiment of a table according to the present invention which is useful in connection with hand surgery.

Advantageously, by providing uniform spacing between the plugs 7 on a table end, a wide variety of differently sized and shaped tables may be used with the same clamp. The table assembly is, therefore, very versatile. The table 29 shown in FIG. 9, for example, has been found to be very useful in performing hand surgery. Preferably the table is about 22" in length, and 26" in width at the ends 30, 31. The sides 32, 33 converge arcuately toward the middle 34 of the table at an arc of about 18" in radius. Thus, extensions 35 are formed on the table for supporting an patient's elbow, thereby allowing the hand to be positioned centrally on the top surface 36 of the table for surgery and/or x-ray imaging.

Figure 10:
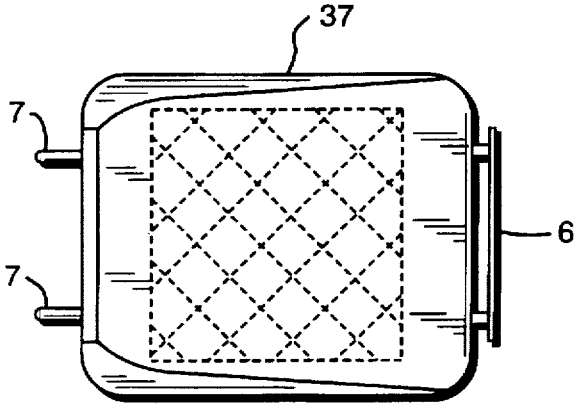
FIG. 10: is a top view of a second alternative embodiment of a table according to the present invention which is useful in connection with pediatric care.
Figure 11:
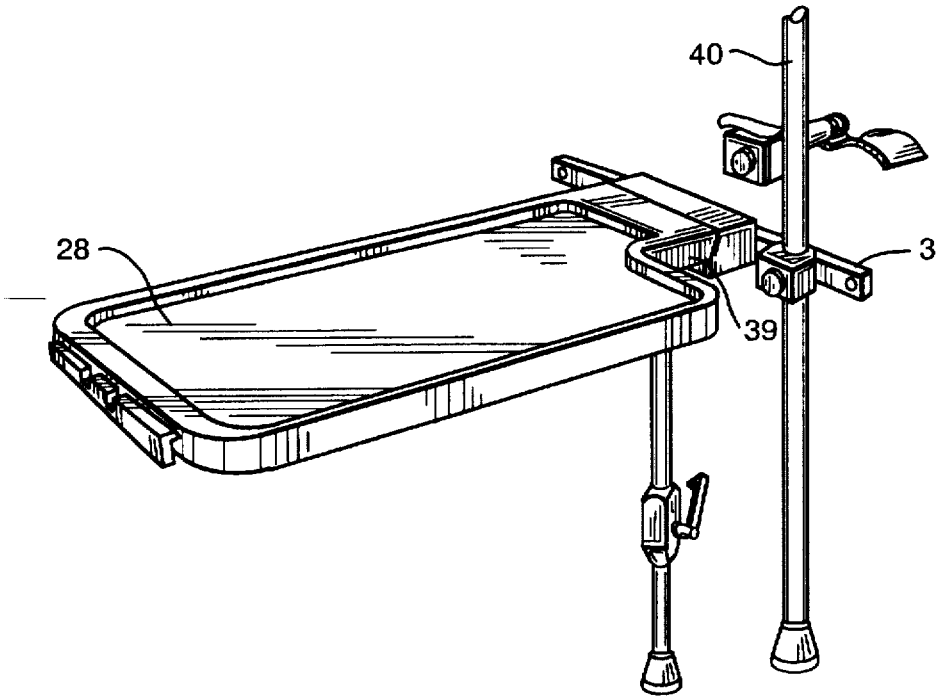
FIG. 11: is a perspective view of a third alternative embodiment of a table according to the present invention which is useful where tower tractioning is necessary.

Other differently sized and shaped tables are necessary depending on the type of surgery to be performed. For example, a table 37 as shown in FIG. 10 of about 22" in length and 18" in width has been found to be useful in connection with pediatric surgeries. Also, as shown in FIG. 11 a table 38 may be formed with a notch 39 to allow for appropriate positioning of a tractioning tower 40 between the table 38 and the surgical rail 3.

Figure 12:
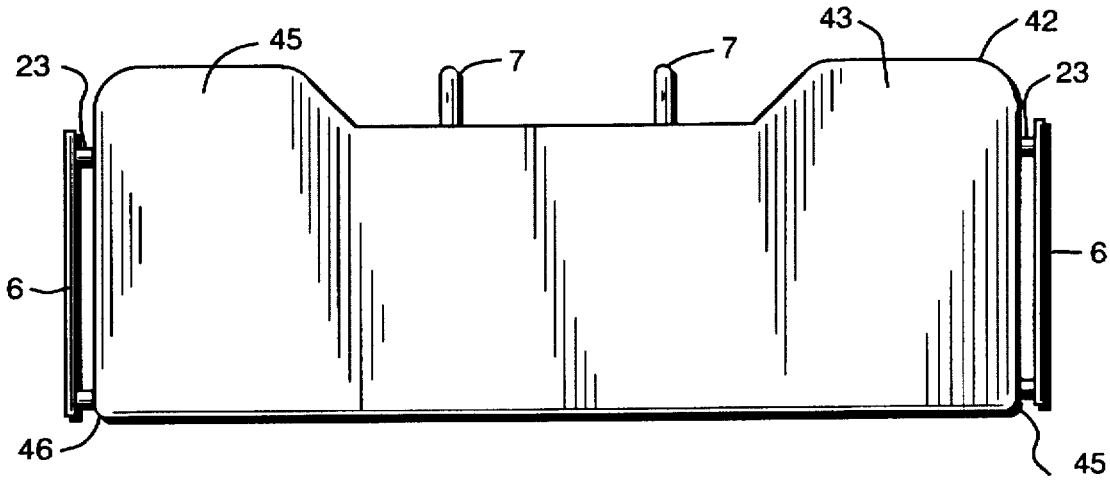
FIG. 12: is a top of a fourth alternative embodiment of a table according to the present invention which is useful as a fracture reduction table.
Figure 13:
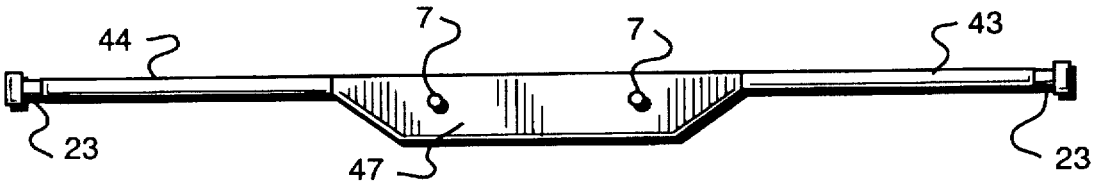
FIG. 13: is a side view of the table shown in FIG. 12.
Figure 14:
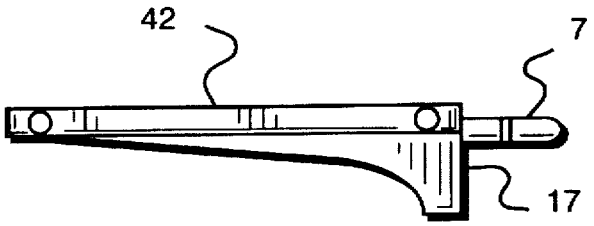
FIG. 14: is an end view of the table shown in FIG. 12.

Another alternative design, useful as a fracture reduction table 42, is shown in FIGS. 12–14. As shown, the table 42 has plugs 7 extending from a side thereof between two extensions 43,44. End rails 6, are formed on each end 45, 46 of the table for securing tractioning equipment. The cross section, shown in FIG. 14, remains generally triangular to provide a large bearing surface 47 between the table and the clamp for supporting loads on the table.

A table according to the present invention, therefore, can take a variety of shapes and sizes depending on its intended use. Since the distance between the plugs 7 remains constant on the tables, the same clamp 2 can be used with any table. In addition, the table is preferably made with triangular cross section to provide a large bearing surface against the clamp for supporting end loads on the table. The table may be made of any material, but is preferably made of a carbon fiber material with a non-compressible foam core to be "invisible" to x-ray imaging and provide light weight.

Turning now to FIGS. 15–19, there is shown a preferred embodiment of a clamp 2 according to the invention having a leg assembly 4 fixed thereto. The clamp housing 48 is single piece which is either machined or die cast from aluminum stock. Preferably the housing is 10.5" in length, 3.188" in height, and 3" in width. Obviously, these dimensions may vary depending on the intended use of the clamp and the size of the table to be attached thereto.

The receptacles 9 are formed in the housing 48 by drilling appropriately sized and positioned bores 49 in both ends 50, 51 of the housing approximately 9" apart. The receptacles are positioned in the housing 48 so that the top of the table to be attached to the clamp is flush with the top of the clamp. The bores are drilled into the housing to a depth which allow the table bearing surface (e.g. 26 in FIG. 5) to contact the face 27 of the clamp to provide support for the table.

Figure 16:
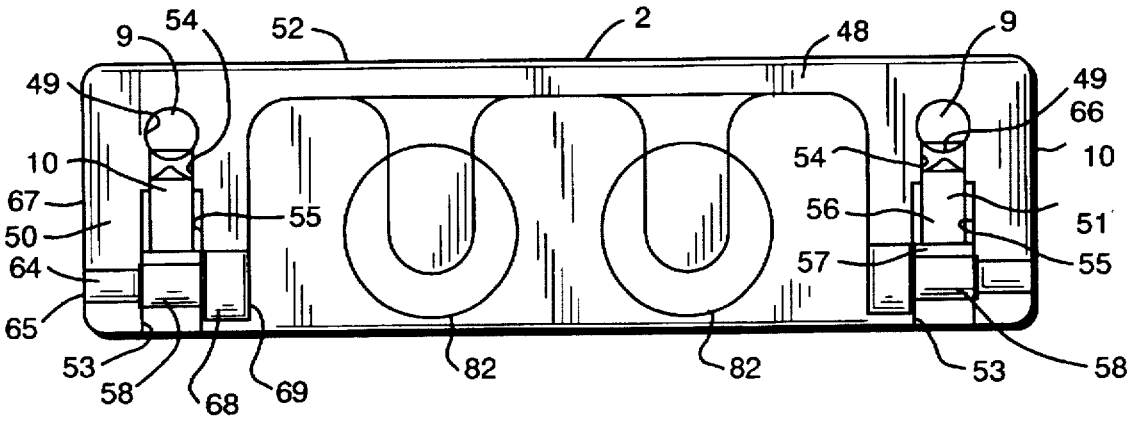
FIG. 16: is a front sectional view of the clamp of FIG. 15.
Figure 17:
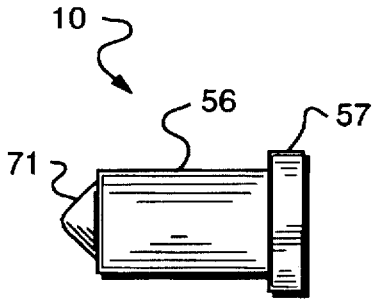
FIG. 17: is a side view of a locking piston for use in a clamp according to the invention.
Figure 18:
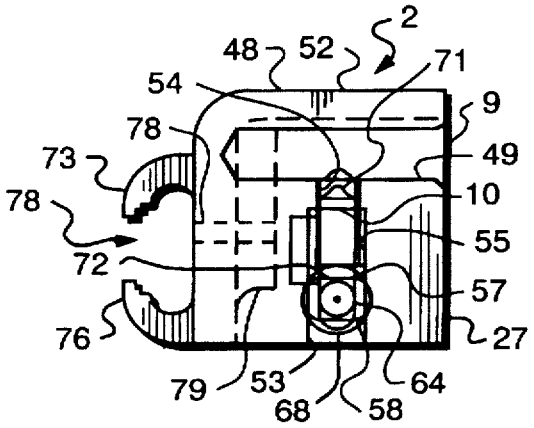
FIG. 18: is a side sectional view of the clamp of FIG. 15.

To lock the plugs 7 within the receptacles 9, a locking piston 10 is mounted in the housing 48 and is arranged to intersect the bore 49 perpendicularly thereto. Referring particularly to FIGS. 16 and 18, piston bores 53 are formed by drilling through the bottom of the housing perpendicularly to the bores 49. The bores 53 have a first section 54 which is drilled through to intersect the bores 49, and a second section 55 which is of larger diameter and extends only a portion of the way through the housing to the bore 49. The locking piston 10, shown particularly in FIG. 17, is positioned within the bore so that its body 56 may extend through bore section 54 to intersect the receptacle bore 49, and its base 57 may extend within the bore section 55.

Figure 19:
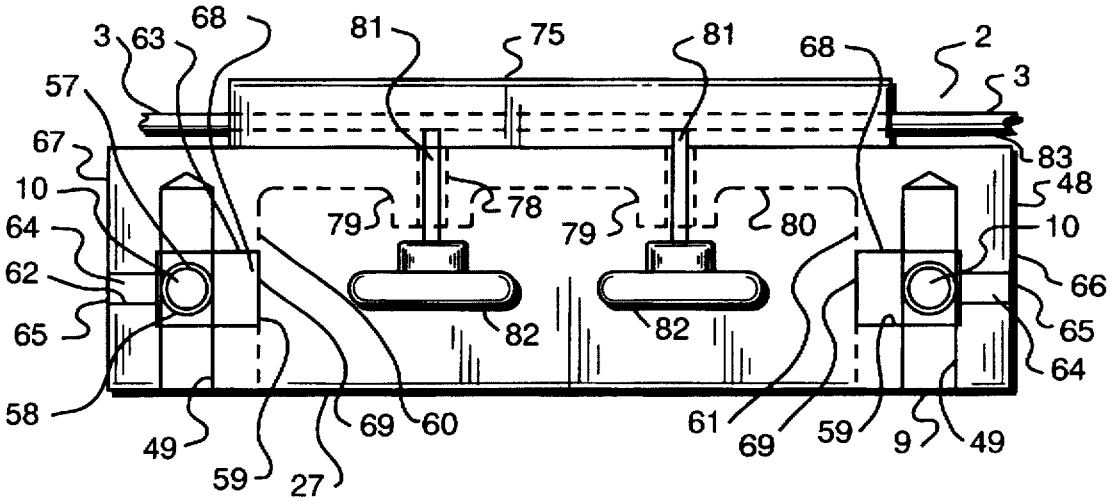
FIG. 19: is a top sectional view of the clamp of FIG. 15.

To provide for axial movement of the piston 10 within the bore 53, the piston 10 is positioned within the bore 53 in contact with a rotatable cam 58. Referring also to FIG. 19, the cams 58 are fixed within the housing 48 in bores 59 drilled through interior side walls 60, 61 of the housing 48. The bore 59 has two sections; a first section 62 which extends completely through the housing from the interior side walls 60, 61, and a second section 63 extends only part way through the housing to intersect the bore 53. The cams 58 are inserted into the bore 59 with an axle portion 64 thereof extending into the first bore section 62 until its end 65 is flush with the ends 66, 67 of the housing 48. The axle portion 64 of the cam 58 is preferably connected to a handle 70 (FIG. 15) so that the cam can be rotated within the bore 59 against plugs 68. The plugs 68 are dimensioned to be inserted into the bores 59 so that their ends 69 are flush with the interior walls 60,61.

As can be seen particularly in FIG. 18, the cam 58 is preferably ellipsoidal in cross section. In an unlocked position the piston 10 rests on the cam 10 on side 72 thereof which is parallel with the its major axis. In this position, the piston 10 is recessed within the bore section 54 so as not to intersect bore 49. Thus, the plugs 7 of a table are free to enter the receptacle 9 into bore 49 without obstruction.

Figure 15:
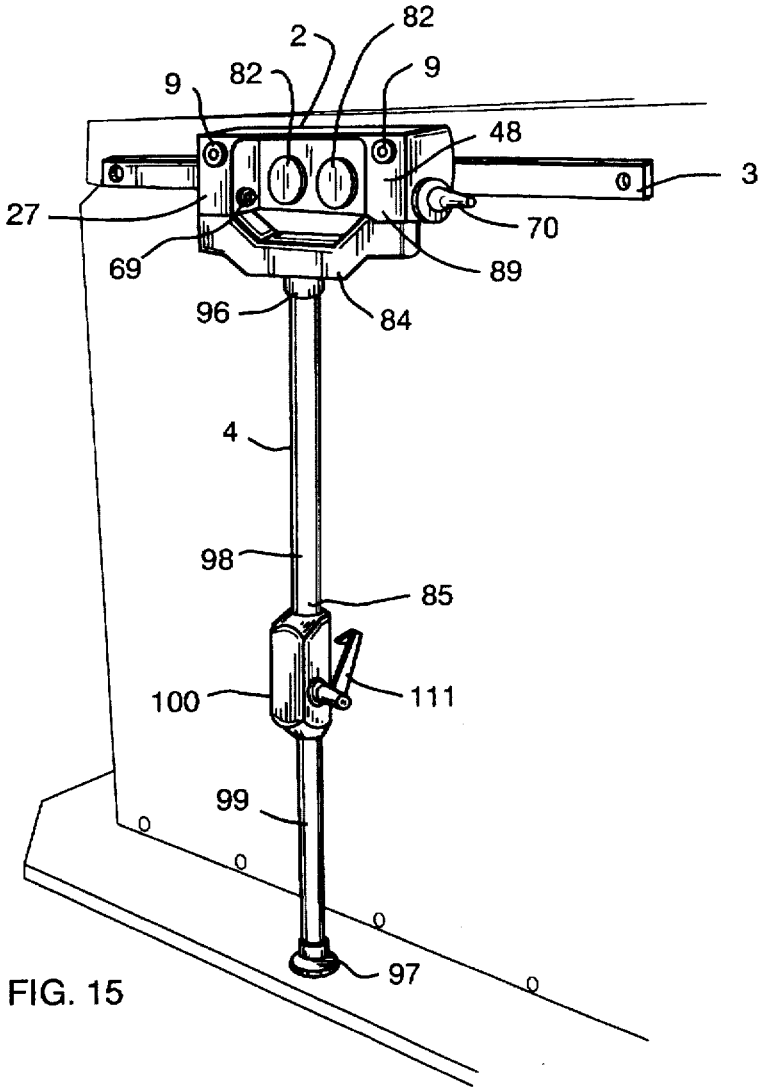
FIG. 15: is a perspective view of one embodiment of a clamp according to the present invention.

Referring now to FIG. 20, once the plugs 7 are completely inserted into bore 49 with the bearing surface 8 of the table 74 resting against the front 27 of the housing, the cam 58 is rotated via handle 70 (FIG. 15). Rotation of the cam causes axial movement of the piston 10 within the bore 53, thereby extending the piston into the bore 49. The plugs 7 are dimensioned and positioned so that the notch 11 is centered just above the intersection of the bore 53 and the bore 49. A pointed end 71 of the piston 10 thus extends into the notch 11 in the plug 7 to lock the plug within the bore 49. In this manner, the table is securely fixed to the clamp. The table may be easily removed from the clamp simply by rotating the cam back into an "unlocked position" whereby the base of the piston extends inward of the bore 53 to allow unobstructed removal of the plug 7 from the bore 49.

Referring still to FIG. 20, the clamp housing 48 is securely fixed to a surgical table rail 3 by jaws 75,76. The housing is rotated upwardly until the edge of the rail 3 fits within the opening 78 between the jaws 75, 76. The housing is then rotated downwardly until the rail 3 is positioned between the jaws as shown in FIG. 20.

Referring also to FIG. 19, to secure the rail 3 within the jaws, threaded bores 78 are formed in protrusions 79 in the rear of the housing. The bores 78 extend through the housing 48 between the jaws 75,76. Screws 81 having handles 82 attached and end thereof matingly engage the threaded bores 78 are turned through the bores into pressing engagement with the front face 83 of the rail. Thus, the rail 3 is secured between the jaws 75,76 and the screws 81 by hand tightening the screws 78 using the handles 82. To remove the clamp, the handles are turned to loosen the screws.

Figure 21:
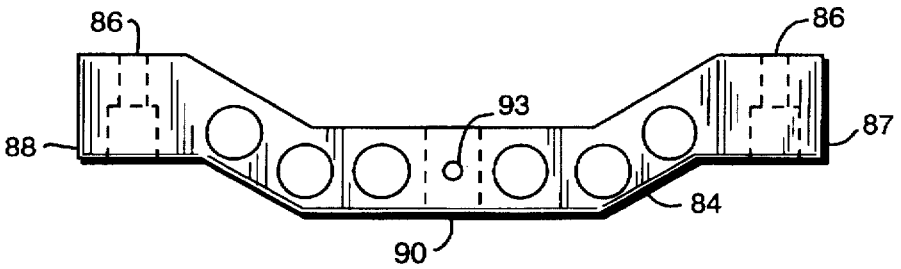
FIG. 21: is a front sectional view of a clamp bracket for mounting a leg assembly to a clamp according to the present invention.
Figure 22:
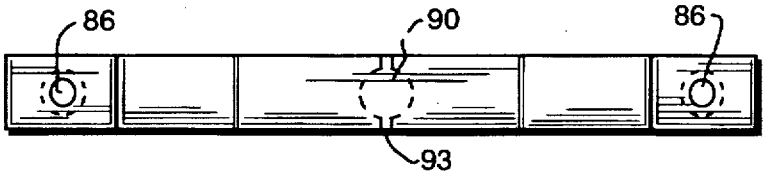
FIG. 22: is a bottom view of the bracket shown in FIG. 21.
Figure 23:
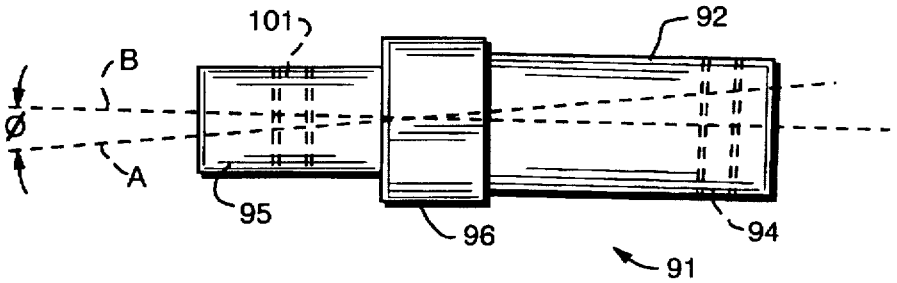
FIG. 23: is a side view of a leg pin according to the present invention.

As shown in FIG. 15, the clamp 2 is further supported by a leg assembly 4 which comprises a bracket 84 and an adjustable leg 85 fixed thereto. The aluminum bracket 84, shown in FIGS. 21–22, has threaded bores 86 through its ends 87,88 which correspond to threaded bores (not shown) on the bottom of the clamp. The bracket is secured to the bottom 89 of the clamp 2 by fastening screws (not shown) through bores 86. Another bore 90 is provided in the center of the clamp 2 for receiving a first section 92 of a leg pin 91, shown particularly in FIG. 23. The bore 90 is intersected by a perpendicular bore 93 which corresponds with a bore 94 in the leg pin 91 for securing the leg pin 91 to the bracket by a screws (not shown).

Figure 25:
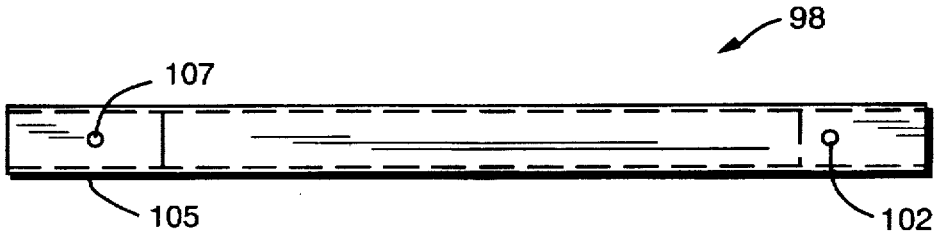
FIG. 25: is a side view of an upper leg portion of a leg assembly according to the invention.

Advantageously, the leg pin 91 has a leg section 95 with its axis A bent to an angle $\phi$ of 2° relative to the axis B of the first section 92 and a middle section 96. The leg assembly 4 is attached to the leg section 95 of the leg pin 91 by a screw through the bore 101 on the leg pin and the bore 102 on the upper leg assembly (FIG. 25). Due to the 2° angle of the leg section 95, the leg assembly 4 is positioned forward of the clamp 2 in the direction of the table. In the preferred embodiment, this results in the bottom 97 of the leg assembly being positioned against the floor at about 3" forward of the axis B (FIG. 23) of the first 92 and middle 96 sections of the leg pin 91. This arrangement, compensates for the tendency for the clamp 2 to rotate on the rail 3 when loads are placed on a table connected thereto.

Figure 24:
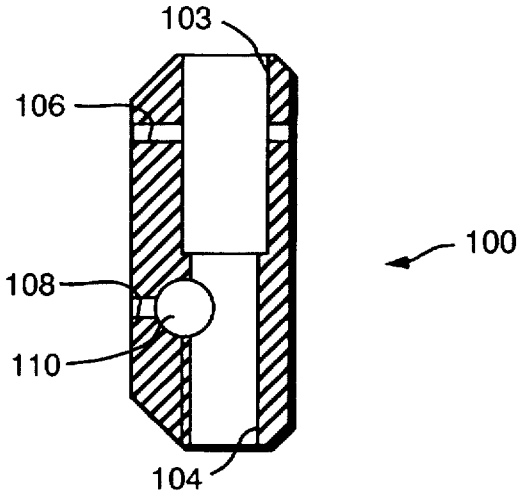
FIG. 24: is a side sectional view of a connector portion of a leg assembly according to the invention.
Figure 26:
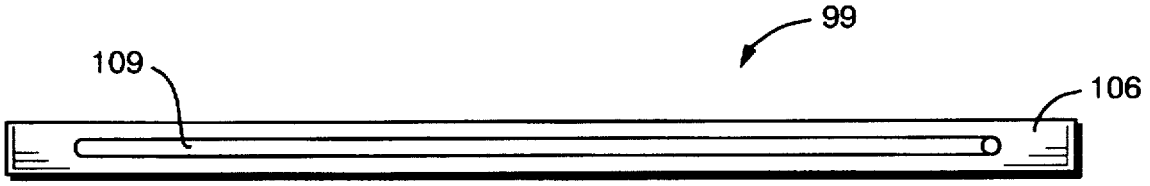
FIG. 26: is a side view of a lower leg portion of a leg assembly according to the invention.

Turning now to FIGS. 24–26, the leg assembly 4 includes an upper leg portion 98, a lower leg portion 99, and connector portion 100. As shown in FIG. 24, the connector portion 100 has an upper bore 103 for receiving the end 105 of the upper leg portion 98, and a lower bore 104 for receiving the end 106 of the lower leg portion 99. The upper leg portion is secured to the connector portion by a screw through bores 106 and 107. The lower leg portion is dimensioned to slide upward into the upper leg portion along a guide pin (not shown) in bore 108 of the connector portion 100, which pin slides within track 109 in the lower leg portion. The connector portion 100 has a threaded bore 110 therein into which a stop pin (not shown) is screwed to adjustably fix the lower leg within the upper leg. To adjust the length of the leg assembly, the stop pin is loosened via the handle 111 (FIG. 15) connected thereto, and the lower leg is positioned as desired within the upper leg. The stop pin is then tightened against the lower leg 99 to fix the lower leg in position.

Figure 29:
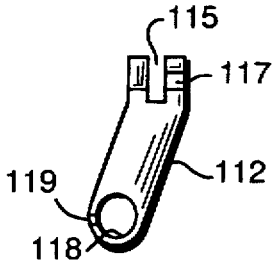
FIG. 29: is a side view of the rail bracket for the outboard leg assembly of FIG. 26.
Figure 31:
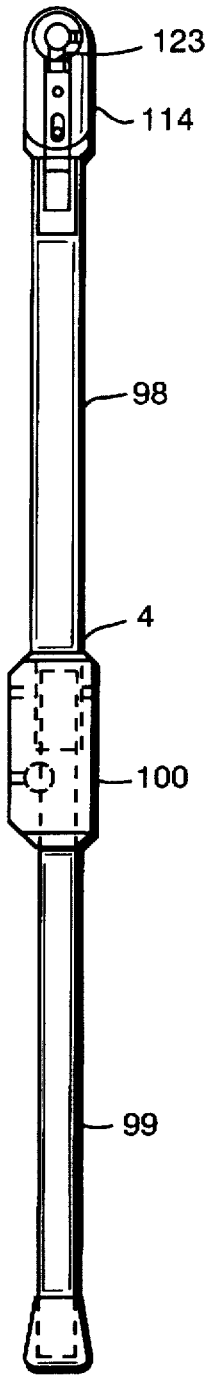
FIG. 31: is side sectional view of the leg assembly attached to the pivot for the outboard leg assembly of FIG. 26.

Turning now to FIG. 27, the same leg assembly 4 is used in the outboard leg assembly. The outboard leg assembly 5 is designed to provide optional support for the end of a table, as shown, and to fold out of the way underneath the table when not in use. The outboard leg assembly includes two rail clamps 112 between which a pivot bar 113 is fixed. The leg assembly 4 attaches to the pivot bar 113 through a leg pivot 114, as shown in FIG. 31. The rail clamps 122 are preferably constructed as shown in FIG. 29, with an opening 115 at one end into which the end rail 6 of a table may be received. The rail clamps 112 are secured by handled screws 116 to the end rail 6 through holes 117.

Figure 30:
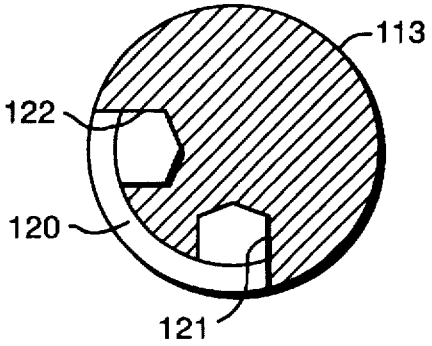
FIG. 30: is side sectional view of the pivot bar for the outboard leg assembly of FIG. 26.

The rail clamps further include a bore 118 into which the pivot bar 113 is fit and secured by screws through holes 119. Referring to FIG. 30, the pivot bar 113 has formed therein a channel 120 and two bores 121, 122 which are spaced 90° apart. The pivot 114 slides over the pivot bar into position adjacent the channel 120 in the pivot bar 113.

As shown in FIG. 31, the pivot 114 has therein an axially extending pin 123 which may be moved into and out of engagement with the bores 121, 122. When the leg assembly 4 is in the down position as shown in FIG. 27, the pin 123 is extended into bore 121 to lock the pivot 114 in position. Advantageously, the leg assembly 4 may be folded under the table by disengaging the pin 123 from bore 121 and rotating the pivot 114 and leg assembly 90° to engage the pin 123 with bore 122. With the pin 123 engaged within bore 122, the leg assembly 4 is securely folded under a table and out of the way. There is thus provided an outboard leg assembly which may be secured to the end of any table for supporting the table for intricate surgeries or heavy loads. The outboard leg is easily removed and installed, and may be folded underneath the table when not in use.

Figure 32:
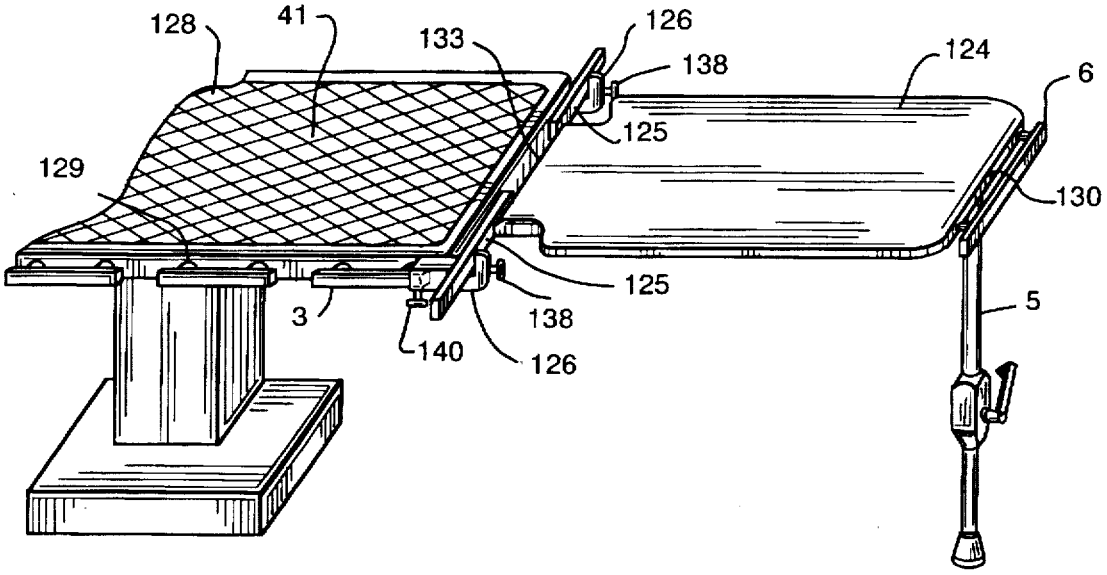
FIG. 32: is perspective view of an alternative portable table assembly according to the invention.
Figure 33:
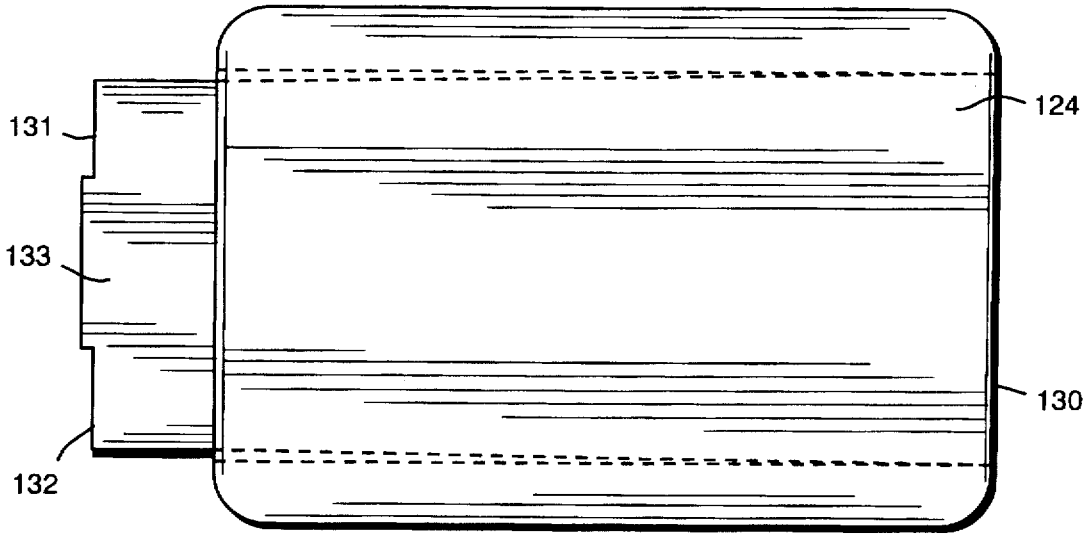
FIG. 33: is top view of a table useful in connection with the alternative portable table assembly shown in FIG. 32.
Figure 34:
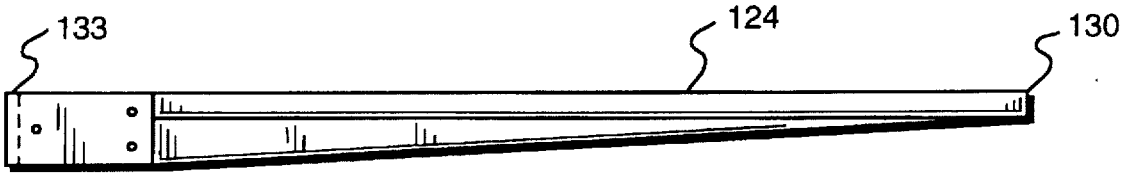
FIG. 34: is a side view of the table shown in FIG. 33.
Figure 35:
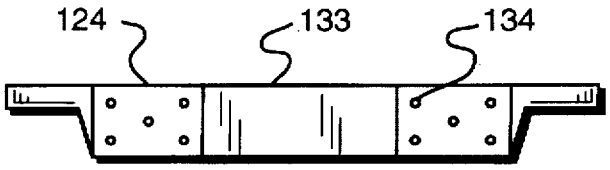
FIG. 35: is an end view of the table shown in FIG. 33.
Figure 36:
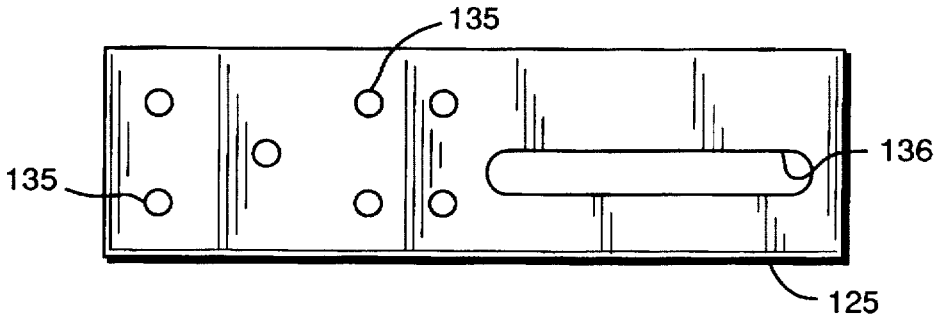
FIG. 36: is a front view of the mounting bracket used in connection with the alternative table assembly shown in FIG. 32.
Figure 37:
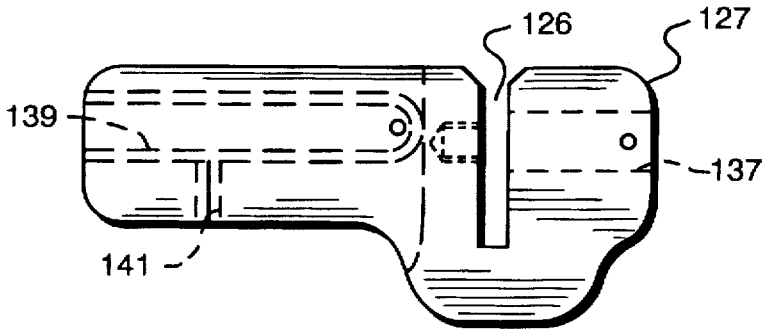
FIG. 37: is a side view of the rail bracket used in connection with the alternative table assembly shown in FIG. 32.
Figure 38:
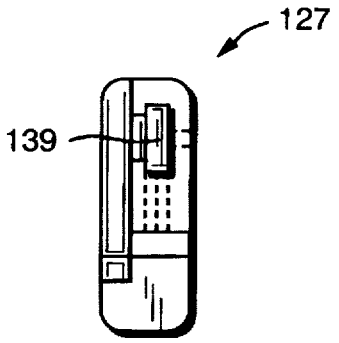
FIG. 38: is an end view of the rail bracket of FIG. 37.
Figure 39:
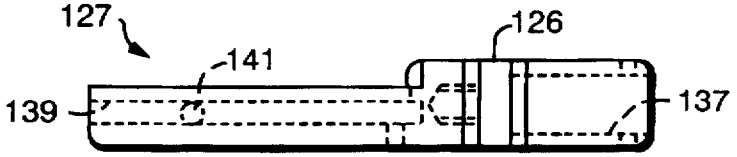
FIG. 39: is a top view of the rail bracket of FIG. 37.
Figure 40:
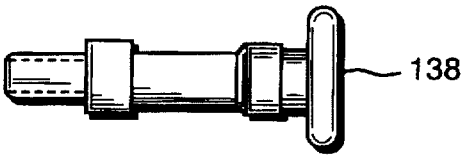
FIG. 40: is a side view of the handled pin for securing the mounting bracket to the rail bracket for the alternative assembly shown in FIG. 32.

Turning now to FIG. 32, there is shown another embodiment of a portable table assembly according to the invention which is useful in providing an extension to another surface, e.g. the surface of a surgical table . The assembly includes a table 124 with mounting brackets 125 fixed thereto. The mounting brackets 125 are received within slots 126 in rail brackets 127 which are secured to the surgical table rails 3 on either side 128, 129 of the surgical table 41. An outboard leg assembly 5, is fixed to a end rail 6 to support the end 130 of the table.

Referring FIG. 33–36, the table has a generally triangular cross section to provide strength and light weight. Notches 131, 132 are formed in the table within which the mounting brackets 125 are fixed. The mounting brackets 125 are screwed to the end 133 of the table through screw holes 134, 135 (FIG. 36) in the table and bracket respectively.

With reference to FIGS. 37–40, the rail brackets 127 include a slot 126 for receiving the mounting brackets 125, which are secured to the rail brackets 127 by a handled pin 138 (FIG. 40) inserted through bore 137 in the rail bracket through the slot 136 in the mounting bracket. The mounting bracket slot 136 is provided to accommodate variations location of the rail bracket 127 on the table. The rail brackets include a slot 139 for receiving the surgical table rail 3. The rail bracket 127 is slid onto the rail 3 and secured to the rail with handled screws 140 through holes 141. Once the rail brackets are installed on the rails, the mounting brackets fixed to the table are simply placed into the slots 126 and secured to the rail brackets with handled pin 138. Advantageously, the mounting brackets may be fixed to any size or shaped table to fix the table flush with the surgical table via the rail clamps. To secure end of the table 130, an outboard leg assembly 5 is fixed to an end rail 6 of the table as described in detail above.

There is thus provided a portable table assembly which is strong, reliable, and easily installed and removed. Advantageously, tables of various sizes and shapes may be used with a single clamp or rail brackets thereby providing broad versatility. The embodiments which have been described herein, however, are but some of the several which utilize this invention, and are set forth here by way of illustration but not of limitation. It is obvious that many other embodiments which will be readily apparent to those skilled in the art may be made without departing materially from the spirit and scope of this invention.

What is claimed is:

1. A portable table assembly comprising:

a table, said table having at least one plug extending from a surface thereof; and a clamp for securing said table to a fixed position, said clamp being removably securable to a fixed position, and having at least one receptacle formed therein, wherein said at least one plug is dimensioned to matingly engage said at least one receptacle thereby securing said table to said clamp, and wherein said table is substantially triangular in at least a portion of its cross section, a base of said triangular cross section being a bearing surface end of said table in contact with a front of said clamp.

2. A portable table assembly according to claim 1, wherein said fixed position is a stationary rail, and wherein said clamp further comprises a pair of jaws formed on a back surface thereof, said jaws being dimensioned to receive said stationary rail therebetween for removably securing said clamp to said stationary rail.

3. A portable table assembly according to claim 1, said table comprising a non-compressible foam core and a carbon fiber outer shell.

4. An outboard leg assembly for supporting an end of a table having an end rail fixed thereto, said outboard leg comprising:

first and second rail brackets, each of said rail brackets having a first and a second end, said first end being adapted to engage said end rail to removably secure said assembly to said end rail;

a pivot bar fixed between said rail brackets adjacent said second ends thereof;

a pivot having a first end and a second end, said first end of said pivot being rotatingly connected to said pivot bar; and an adjustable leg connected to said second end of said pivot.

5. A outboard leg assembly according to claim 4, wherein said adjustable leg comprises:

a connector portion having a central bore therethrough;

an upper leg portion fixed within said central bore and extending from a top of said connector portion; and a lower leg portion within said central bore and extending from a bottom of said connector portion, wherein said lower leg portion is slidable within said central bore and said upper leg portion to adjust said length.

6. A outboard leg assembly according to claim 5, wherein said connector portion comprises:

a stop pin bore formed perpendicularly to said central bore;

and a stop pin fixed within said stop pin bore, said stop pin being axially movable in said stop pin bore to engage said lower leg portion to thereby fix said lower leg portion within said central bore.

7. A portable table assembly comprising:

a table having a non-compressible foam core and a carbon fiber outer shell, said table having a first end; and at least one clamp secured to a first end of said table for securing said table to a fixed position.

8. A portable table assembly according to claim 7 wherein said assembly further comprises a leg connected to a second end of said table.

9. A portable table assembly according to claim 1, wherein said connector portion comprises:

a stop pin bore formed perpendicularly to said central bore;

and a stop pin fixed within said stop pin bore, said stop pin being axially movable in said stop pin bore to engage said lower leg portion to thereby fix said lower leg portion within said central bore.

10. A portable table assembly according to claim 7, wherein said table is substantially triangular in at least a portion of its cross section, a base of said triangular cross section being a bearing surface end of said table in contact with a front of said clamp.

11. A portable table assembly comprising:

a table, said table having at least one plug extending from a surface thereof, said plug having a notch formed therein; and a clamp for securing said table to a fixed position, said clamp having at least one receptacle bore formed in a housing of said clamp, said receptacle bore being dimensioned to matingly receive said at least one plug, said clamp further comprising a piston bore perpendicularly intersecting said receptacle bore, and a piston in said piston bore, said piston being axially movable in said piston bore to intersect said notch, said plug thereby being releasably locked within said receptacle bore for securing said table to said clamp.

12. A portable table assembly according to claim 11, wherein said piston is positioned against a cam in said piston bore, said piston being axially movable in said piston bore upon rotation of said cam.

13. A portable table assembly according to claim 12, wherein said cam has an ellipsoidal cross section.

14. A portable table assembly comprising:

a table, said table having at least one plug extending from a surface thereof;

a clamp for securing said table to a fixed position, said clamp having at least one receptacle formed therein; and a leg fixed to a bottom of said clamp, wherein said at least one plug is dimensioned to matingly engage said at least one receptacle thereby securing said table to said clamp.

15. A portable table assembly according to claim 14, wherein said leg is connected to said bottom of said clamp through a leg bracket, said leg bracket comprising a leg pin fixed thereto, said leg being connected to said leg pin.

16. A portable table assembly according to claim 15, wherein said leg pin extends from said leg bracket angularly in the direction of said table to prevent downward rotation of said clamp.

17. A portable table assembly according to claim 11, wherein said leg pin extends from said leg bracket at an angle of 2° in the direction of said table.

18. A portable table assembly according to claim 14, wherein said leg is an adjustable leg having adjustable length, said adjustable leg comprising:

a connector portion having a central bore therethrough;

an upper leg portion fixed within said central bore and extending from a top of said connector portion; and a lower leg portion within said central bore and extending from a bottom of said connector portion, wherein said lower leg is slidable within said central bore and said upper leg portion to adjust said length.

19. A portable table assembly according to claim 18, wherein said connector portion comprises:

a stop pin bore formed perpendicularly to said central bore;

and a stop pin fixed within said stop pin bore, said stop pin being axially movable in said stop pin bore to engage said lower leg portion to thereby fix said lower leg portion within said central bore.

20. A portable table assembly comprising:

a table, said table having at least one plug extending from a surface thereof and an end rail fixed to an end thereof;

a leg fixed to said end rail for supporting said end; and a clamp for securing said table to a fixed position, said clamp having at least one receptacle formed therein, wherein said at least one plug is dimensioned to matingly engage said at least one receptacle thereby securing said table to said clamp.

21. A portable table assembly according to claim 20, wherein said leg is an adjustable leg having adjustable length, said adjustable leg comprising:

a connector portion having a central bore therethrough;

an upper leg portion fixed within said central bore and extending from a top of said connector portion; and a lower leg portion within said central bore and extending from a bottom of said connector portion, wherein said lower leg portion is slidable within said central bore and said upper leg portion to adjust said length.

22. A portable table assembly according to claim 21, wherein said connector portion comprises:

a stop pin bore formed perpendicularly to said central bore;

and a stop pin fixed within said stop pin bore, said stop pin being axially movable in said stop pin bore to engage said lower leg portion to thereby fix said lower leg portion within said central bore.

23. A portable table assembly according to claim 20, wherein said leg comprises an outboard leg assembly, said outboard leg assembly comprising:

a pair of rail brackets, each of said rail brackets having a first and a second end, said first end being adapted to engage said end rail to secure said assembly to said end rail;

a pivot bar fixed between said rail brackets adjacent said second ends thereof;

a pivot having a first end and a second end, said first end of said pivot being rotatingly connected to said pivot bar; and an adjustable leg connected to said second end of said pivot.

24. A clamp for use in connection with a portable table assembly, wherein said assembly comprises a table to be secured to a fixed location by connection to said clamp, said clamp comprising:

at least one receptacle bore formed in a housing of said clamp, said at least one receptacle being adapted to be matingly engaged by a corresponding plug extending from a surface of said table and having a notch formed therein, thereby securing said table to said clamp;

a piston bore perpendicularly intersecting said receptacle bore; and a piston in said piston bore, said piston being axially movable in said piston bore to intersect said notch in said plug, said plug thereby being releasably locked within said receptacle bore.

25. A clamp according to claim 24, wherein said piston is positioned against a cam in said piston bore, said piston being axially movable in said piston bore upon rotation of said cam.

26. A portable table assembly according to claim 25, wherein said cam has an ellipsoidal cross section.

27. A clamp for use in connection with a portable table assembly, wherein said assembly comprises a table to be secured to a fixed location by connection to said clamp, said clamp comprising:

a leg fixed to a bottom of said clamp; and at least one receptacle formed in a surface of said clamp, said at least one receptacle being adapted to be matingly engaged by a corresponding plug extending from a surface of said table, thereby securing said table to said clamp.

28. A clamp according to claim 27, wherein said leg is connected to said bottom of said clamp through a leg bracket, said leg bracket comprising a leg pin fixed thereto, said leg being connected to said leg pin.

29. A clamp according to claim 28, wherein said leg pin extends from said leg bracket angularly in the direction of said table to prevent downward rotation of said clamp.

30. A clamp according to claim 29, wherein said leg pin extends from said leg bracket at an angle of 2° in the direction of said table.

31. A clamp according to claim 27, wherein said leg is an adjustable leg having adjustable length, said adjustable leg comprising:

a connector portion having a central bore therethrough;

an upper leg portion fixed within said central bore and extending from a top of said connector portion; and a lower leg portion within said central bore and extending from a bottom of said connector portion, wherein said lower leg portion is slidable within said central bore and said upper leg portion to adjust said length.

32. A clamp according to claim 31, wherein said connector portion comprises:

a stop pin bore formed perpendicularly to said central bore;

and a stop pin fixed within said stop pin bore, said stop pin being axially movable in said stop pin bore to engage said lower leg portion to thereby fix said lower leg portion within said central bore.

33. A portable table assembly comprising:

a table, said table having at least one plug extending from a surface thereof; and a clamp for securing said table to a fixed position, said clamp having at least one receptacle formed therein and a pair of jaws formed on a back surface thereof, wherein said at least one plug is dimensioned to matingly engage said at least one receptacle thereby securing said table to said clamp, and wherein said jaws are dimensioned to receive a stationary rail therebetween to secure said clamp to a fixed location.

34. A portable table assembly comprising:

a table, said table being substantially triangular in at least a portion of its cross section, and having at least one plug extending from a surface thereof; and a clamp for securing said table to a fixed position, said clamp having at least one receptacle formed therein, wherein said at least one plug is dimensioned to matingly engage said at least one receptacle thereby securing said table to said clamp, and wherein a base of said substantially triangular cross section is a bearing surface end of said table in contact with a front of said clamp.

35. A portable table assembly comprising:

a table having a non-compressible foam core and a carbon fiber outer shell, said table having at least one plug extending from a surface thereof; and a clamp for securing said table to a fixed position, said clamp having at least one receptacle formed therein, wherein said at least one plug is dimensioned to matingly engage said at least one receptacle thereby securing said table to said clamp.

36. A table for use in connection with a portable table assembly, wherein said assembly comprises a clamp for removably securing said table to a fixed location, said table comprising:

at least one plug extending from a surface of said table, said at least one plug being adapted to matingly engage a corresponding receptacle formed in said clamp, thereby securing said table to said clamp, wherein said table is substantially triangular in at least a portion of its cross section, a base of said substantially triangular cross section being a bearing surface end of said table in contact with a front of said clamp.

37. A table for use in connection with a portable table assembly, wherein said assembly comprises a clamp for removably securing said table to a fixed location, said table comprising:

a non-compressible foam core with a carbon fiber outer shell; and at least one plug extending from a surface of said table, said at least one plug being adapted to matingly engage a corresponding receptacle formed in said clamp, thereby securing said table to said clamp.

38. A clamp for use in connection with a portable table assembly, wherein said assembly comprises a table to be secured to a fixed location by connection to said clamp, said clamp comprising:

at least one receptacle formed in a surface of said clamp, said at least one receptacle being adapted to be matingly engaged by a corresponding plug extending from a surface of said table, thereby securing said table to said clamp; and a pair of jaws formed on a back surface of said clamp, said jaws being dimensioned to receive a stationary rail therebetween to secure said clamp to a fixed location.

39. A portable table assembly comprising:

a table, said table having a first end;

at least one mounting bracket secured to a first end of said table;

at least one rail bracket for securing said table to a fixed position, said rail bracket having a slot formed therein for removably receiving said mounting bracket to thereby secure said table to said rail bracket; and an adjustable leg connected to a second end of said table, said adjustable leg having a connector portion having a central bore therethrough, an upper leg portion fixed within said central bore and extending from a top of said connector portion, and a lower leg portion within said central bore and extending from a bottom of said connector portion, wherein said lower leg portion is slidable within said central bore and said upper leg portion to adjust said length.

40. A portable table assembly comprising:

a table, said table having a first end; and at least one clamp secured to a first end of said table for securing said table to a fixed position, wherein said table is substantially triangular in at least a portion of its cross section, a base of said substantially triangular cross section being a bearing surface end of said table in contact with a front of said clamp.

* * * * *